US005648839A

United States Patent [19]

Koshino et al.

[11] Patent Number: 5,648,839

[45] Date of Patent: Jul. 15, 1997

[54] IMAGE FORMING APPARATUS

[75] Inventors: Toshiharu Koshino, Kadoma; Kazumasa Hayashi, Osaka; Hiroshi Komakine, Moriguchi; Kenji Asakura, Katano; Katsutoshi Ogawa, Hirakata, all of Japan

[73] Assignee: Matsushita Electric Industrial Co., Ltd., Osaka, Japan

[21] Appl. No.: 422,891

[22] Filed: Apr. 17, 1995

[30] Foreign Application Priority Data

Apr. 27, 1994 [JP] Japan ..... 6-089586

[51] Int. Cl.[6] ..... G03G 15/09

[52] U.S. Cl. ..... 399/271

[58] Field of Search ..... 355/245, 251, 355/253, 210, 200; 118/653, 656–658

[56] References Cited

U.S. PATENT DOCUMENTS

| | | | |
|---|---|---|---|
| 3,953,121 | 4/1976 | Reichart, Jr. | 355/245 |
| 4,324,199 | 4/1982 | Morikawa | 118/658 |
| 4,426,148 | 1/1984 | Ikemoto et al. | 118/658 X |
| 4,872,418 | 10/1989 | Yoshikawa et al. | 118/657 |
| 5,089,849 | 2/1992 | Hiraoka | 118/661 X |
| 5,223,893 | 6/1993 | Ikemoto et al. | 355/200 |
| 5,283,619 | 2/1994 | Nomura et al. | 118/657 X |
| 5,293,199 | 3/1994 | Saito et al. | 355/245 X |
| 5,434,651 | 7/1995 | Aizawa et al. | 355/245 X |
| 5,488,341 | 1/1996 | Yamamoto et al. | 355/251 X |
| 5,488,465 | 1/1996 | Yamamoto et al. | 355/251 X |

FOREIGN PATENT DOCUMENTS

| | | | |
|---|---|---|---|
| 2937063 | 3/1981 | Germany | 355/251 |
| 4145471 | 5/1992 | Japan | 355/251 |
| 5241449 | 9/1993 | Japan | 355/251 |
| 6161266 | 6/1994 | Japan | 355/251 |

OTHER PUBLICATIONS

*Xerox Disclosure Journal*, vol. 5, No. 4, "Spacing Method for Developer", Bean, L.F., Jul./Aug. 1980.

*Primary Examiner*—Matthew S. Smith

*Attorney, Agent, or Firm*—Fish & Richardson, P.C.

[57] ABSTRACT

An image forming apparatus includes a photoconductor, a developing electrode, at least a magnet disposed in the developing electrode, and a developer. The developing electrode is reciprocally movable against a rotation axis of the photoconductor. Thus, a setting angle of a magnetic pole of the magnet is not varied, even when the developing electrode is moved for cancelling decentering and deflection of the photoconductor and the developing electrode.

35 Claims, 11 Drawing Sheets

IMAGE FORMING APPARATUS

FIELD OF THE INVENTION

This invention relates to an image forming apparatus which is used in a document copier, a facsimile, a laser printer etc., which forms an image with an electrophotographic system.

BACKGROUND OF THE INVENTION

In recent years, a new type image forming apparatus, which is, for example, shown in Publication Gazette of Unexamined Japanese Patent Application Hei 6-95489, has been proposed. In the conventional image forming apparatus, a cylindrical developing electrode having a magnet coaxially provided with its rotation axis is disposed parallel to a cylindrical photoconductor with a predetermined developing gap. A gap restricting member is provided between the photoconductor and the developing electrode. The developing electrode is pressed on the gap restricting member, for example, by a spring, and the gap restricting member contacts the photoconductor. Thus, a width of the developing gap is defined by a thickness of the gap restricting member.

There are decentering and deflection in the photoconductor and developing electrode. Since the developing electrode is pivoted by an arm, effects of the decentering and deflection are cancelled by revolution movement of the developing electrode around a rotation axis of the arm. The developing electrode and magnet are not moved reciprocally but revolve against an axial standard line which links the rotation axes of the photoconductor and developing electrode. Thus, an angle of a magnetic center line linking a position of the magnetic pole and the rotation axis of the developing electrode against the axial standard line will be changed. When the magnetic pole is displaced from the original setting position, gradation of a picture image will be damaged or background development of toner will occur in non-image part of a paper sheet responding to rotation frequency of the photoconductor or developing electrode.

A condition that a setting angle of the magnet is changed by revolution of the developing electrode is schematically shown in FIG. 19. In FIG. 19, the original positions of the rotation axis of the photoconductor O, the rotation axis of the developing electrode Q, the axial standard line L, the magnetic center line QM and the rotation axis P of the arm are shown by real lines. Under this condition, the distance between the rotation axis O of the photoconductor and the rotation axis Q of the developing electrode changes due to the decentering and deflection of the photoconductor and the developing electrode. At this time, the developing electrode moves to a position shown by dotted line by the revolution around the rotation axis P of the arm. As a result, the rotation center Q of the developing electrode moves to a position designated by Q', and the axial standard line L changes to a line designated by L'. Furthermore, the magnetic center line QM changes to a line designated by Q'M'.

A crossing angle $\Theta$ of the lines L and M changes to a crossing angle $\Theta'$ of lines L' and M'. In these angles, a relation of $\Theta'-\Theta=\delta 1+\delta 2$ is concluded. Namely, the setting angle of the magnetic pole against the axial standard line L is changed by $(\delta 1+\delta 2)$. This phenomenon is caused by not the reciprocal movement but the revolution movement of the developing electrode and the magnet against the axial standard line L.

Especially, an image forming method shown in Publication Gazette of Unexamined Japanese Patent Application Hei 6-95489, magnets are provided not only in the developing electrode but also in the photoconductor. Therefore, not only a balance but also the relative positions of the magnets become more important. Minute changes of the setting angles of the magnets largely change the magnetic field generated in a developing nip part, and largely affect the quality of picture images.

Furthermore, the developing electrode and the photoconductor are respectively borne by different housings of developing unit and photoconductor unit. Thus, accuracy of the position of the photoconductor against the developing electrode cannot be guaranteed. As a result, quality of the picture image is largely reduced.

SUMMARY OF THE INVENTION

An objective of this invention is to provide an improved image forming apparatus which can generate a predetermined magnetic field precisely and stably in the developing nip part, thereby forming a high resolution and high quality picture image.

For attaining this objective, an image forming apparatus of this invention comprises: an image holder which is rotated around a rotation axis thereof and holds a pattern of electric charge corresponding to a picture image on a surface thereof: a magnetic developer; a developing electrode which faces the surface of the image holder with a predetermined gap, is rotated around a rotation axis thereof, and reciprocally movable in a predetermined direction on a plane perpendicular to the rotation axis: pressing means for supplying a pressing force to the developing electrode in the predetermined direction to the image holder; gap restricting means provided between the image holder and the developing electrode for restricting a distance between surfaces of the image holder and the developing electrode in the gap in a predetermined value; first magnetic field generating means which is coaxially provided on the rotation axis of the developing electrode and is not rotative against the rotation axis; electric field generating means for generating electric field in a developing nip part of the image holder and the developing electrode; and a housing in which the image holder and the developing electrode are disposed.

By the above-mentioned configuration, since the developing electrode is pressed on the gap restricting means, and the gap restricting means is pressed on the image holder, the distance between the surfaces of image holder and the developing electrode can be restricted at a predetermined value corresponding to the thickness of gap restricting means.

The developing electrode can be moved as reciprocal movement against the image holder. The first magnetic field generating means is coaxially provided on the rotation axis of the developing electrode and it is not rotative against the rotation axis. Thus, when the distance between the rotation axis of the image holder and the rotation axis of the developing electrode is changed by the reciprocal movement of the developing electrode for cancelling the decentering and deflection of the image holder and the developing electrode, the coaxially of the developing electrode and the magnetic field generating means and a setting angle of a magnetic pole of the magnetic field generating means, such as a magnet, will not be varied. As a result, the magnetic field can be generated stably and precisely in the developing nip part, and a high resolution and high quality picture image can be formed. The image holder and the developing electrode are disposed in the same housing, so that accuracy of the relative positions, such as, the parallelism, the direction of the axial standard line, and the like, of the image holder and the developing electrode can be maintained easily.

Furthermore, it is preferable that a first center shaft is coaxially disposed on the rotation axis of the developing electrode, at least an end of the first center shaft is engaged with a first center shaft guide groove, the first magnetic generating means is fixed on the first center shaft, and rotation of the first center shaft is restricted by first rotation restricting means.

By such a configuration, the first center shaft, the first magnetic field generating means and the developing electrode can be moved integrally, but the first center shaft and the first magnetic field generating means may not be rotated. Thus, even when the developing electrode is reciprocally moved, the variation of the setting angle of the first magnetic field generating means can be made smaller.

Furthermore, it is preferable further to comprise: developer accumulating means facing an outer surface of the image holder and temporarily accumulating the developer; a second center shaft coaxially disposed on a rotation axis of the image holder; second magnetic field generating means integrally fixed on the second center shaft and generating a magnetic field on a surface of the image holder; and second rotation restricting means for restricting rotation of the second center shaft.

By such a configuration, magnetic fields are generated not only the surface of the developing electrode, but also the surface of the image holder. Furthermore, the second center shaft can not be rotated by the second rotation restricting means, so that the variation of the setting angle of second magnetic field generating means can be made smaller. As a result, the magnetic field generated by the second magnetic field generating means can be made more stable and accurate.

On the other hand, another image forming apparatus of this invention comprises: an image holder which is rotatable around a rotation axis thereof and capable of holding a pattern of electric charge corresponding to a picture image on a surface thereof; developer accumulating means facing an outer surface of the image holder; a magnetic developer which is supplied from the developer accumulating means to the outer surface of the image holder; a developing electrode which faces the surface of the image holder with a predetermined gap, is rotatable around a rotation axis thereof in the opposite direction to the rotation direction of the image holder, and reciprocally movable in a predetermined direction; a first center shaft which is coaxially disposed on the rotation axis of the developing electrode, at least one end of the first center shaft being engaged with a first center shaft guide groove; first rotation restricting means for restricting rotation of the first center shaft; pressing means for supplying a pressing force to the developing electrode in the predetermined direction; gap restricting means provided between the image holder and the developing electrode for restricting a distance between surfaces of the image holder and the developing electrode in the gap to a predetermined value; first magnetic field generating means which is coaxially fixed on the first center shaft and is not rotatable about the rotation axis of the developing electrode; electric field generating means for generating an electric field in a developing nip part of the image holder and the developing electrode; a housing in which the image holder and the developing electrode are disposed; a second center shaft coaxially disposed on a rotation axis of the image holder; second magnetic field generating means integrally fixed on the second center shaft and generating a magnetic field on a surface of the image holder; and second rotation restricting means for restricting rotation of the second center shaft.

By the above-mentioned configuration, since the developing electrode is pressed on the gap restricting means, and the gap restricting means is pressed on the image holder, the distance between the surfaces of image holder and the developing electrode can be restricted at a predetermined value corresponding to the thickness of gap restricting means. The developing electrode can be moved as reciprocal movement against the image holder. The first magnetic field generating means is coaxially provided on the rotation axis of the developing electrode and it is not rotative against the rotation axis. Thus, when the distance between the rotation axis of the image holder and the rotation axis of the developing electrode is changed by the reciprocal movement of the developing electrode for cancelling the decentering and deflection of the image holder and the developing electrode, the coaxiality of the developing electrode and the magnetic field generating means and a setting angle of a magnetic pole of the magnetic field generating means, such as a magnet, will not be varied. As a result, the magnetic field can be generated stably and precisely in the developing nip part, and a high resolution and high quality picture image can be formed. The image holder and the developing electrode are disposed in the same housing, so that accuracy of the relative positions, such as, the parallelism, the direction of the axial standard line, and the like, of the image holder and the developing electrode can be maintained easily.

The first center shaft, the first magnetic field generating means and the developing electrode can be moved integrally, but the first center shaft and the first magnetic field generating means may not be rotated. Thus, even when the developing electrode is reciprocally moved, the variation of the setting angle of the first magnetic field generating means can be made smaller.

Magnetic fields are generated not only the surface of the developing electrode, but also the surface of the image holder. Furthermore, the second center shaft can not be rotated by the second rotation restricting means, so that the variation of the setting angle of second magnetic field generating means can be made smaller. As a result, the magnetic field generated by the second magnetic field generating means can be made more stable and accurate.

In the above-mentioned configures, it is preferable that the pressing means is a coil spring disposed in the first center shaft guide groove for applying a pressing force to the first center shaft.

By such a configuration, the pressing force of the pressing means can be applied to the developing electrode via the first center shaft. Thus, the developing electrode can be moved smoothly, and it can be pressed on the gap restricting means evenly.

Furthermore, it is preferable that the first rotation restricting means is comprised of a first rotation restricting part formed at least one end of the first center shaft and at least a side wall of the first center shaft guide groove.

By the such a configuration, the first center shaft guide groove can serve for not only guiding the reciprocal movement of the developing electrode, but also restricting the rotation of the first center shaft and the first magnetic field generating means. As a result, the configuration of the apparatus can be made simple.

Furthermore, it is preferable that the first rotation restricting part has a substantially D-shaped cross-section in a plane perpendicular to the rotation axis of the developing electrode, and a flat face of the D-shaped cross-section of the first rotation restricting part contacts the side wall of the first center shaft guide groove.

By such a configuration, the configuration of the first rotation restricting means can be made simple, and the number of elements for constituting the apparatus can be reduced.

Furthermore, it is preferable that the first center shaft guide groove has a pair of side walls parallel to the direction of the reciprocal movement of the developing electrode, and a width between the side walls is substantially the same as a height from the flat face to a top of cylindrical face of the D-shaped cross-section of the first rotation restricting part.

By such a configuration, a clearance between the first center shaft and the first center shaft guide groove can be made small. Thus, the reciprocal movement of the developing electrode can be made smooth and precise. As a result, the variation of the setting angle of the first magnetic field generating means can be made much smaller.

Alternatively, it is preferable that the first rotation restricting means is comprised of a first pin which is protruded from a cylindrical face of the first center shaft and a first rotation restricting groove with which the first pin is engaged.

By such a configuration, the length of the rotation restricting part for restricting the first center shaft can be made longer. Thus, the error of the setting angle of the first magnetic field generating means is not enlarged as much.

Alternatively, it is preferable that reciprocal movement of the developing electrode is guided by a developing electrode guide means which is independently provided From the First center shaft guide groove.

By such a configuration, the reciprocal movement of the developing electrode can be guided independently from the first center shaft guide means. Also, a bending moment acting at four pressure points between the pressing means and bearing parts of the developing electrode can be cancelled.

In the above-mentioned configuration, it is preferable that the developing electrode guide means is comprised of a protrusion formed on a flange of the developing electrode and a developing electrode guide groove.

Furthermore, it is preferable that the pressing means is a coil spring disposed in the developing electrode guide groove for applying a pressing force to the protrusion of the flange.

By such a configuration, the protrusion of the flange is pressed by the pressing means, and is inserted into the developing electrode guide groove, so that the protrusion of the flange and side walls of the guide groove can receive the external forces. Thus, the bending moment acting on the first center shaft and the first magnetic field generating means can be prevented, and warping will not occur.

Furthermore, it is preferable that a ring is engaged with the protrusion, and the ring slides on side walls of the developing electrode guide groove.

By such a configuration, the ring is guided by the guide groove, and the pressing means is provided between the ring and the guide groove. Thus, the pressing force of the pressing means is supplied to the ring which is not rotatable. As a result, an end of the pressing means such as a coil spring may not be caught into the rotating bearing of developing electrode.

Furthermore, it is preferable that the pressing means is a coil spring disposed in the developing electrode guide groove for applying a pressing force to the ring.

By such a configuration, the ring is engaged with the protrusion of the flange, and the bearing of developing electrode is configured by the protrusion of the flange and the ring. Furthermore, the ring is guided by the guide groove, and the pressing means is provided between the ring and the guide groove. Thus, the pressing force of the pressing means is supplied to the ring which is not rotatable. As a result, the bending moment acting on the first center shaft and the first magnetic field generating means can be prevented, and warping will not occur.

Furthermore, it is preferable that the second rotation restricting means is comprised of a second rotation restricting part having a substantially D-shaped cross-section in a plane perpendicular to the rotation axis of the image holder and formed on at least one end of the second center shaft, and a second center shaft guide hole having substantially the same cross-section as that of the second rotation restricting part with which the second rotation restricting part is engaged.

By such a configuration, the configuration of the second rotation restricting means can be made simple, and the number of elements for constituting the apparatus can be reduced.

Alternatively, it is preferable that the second rotation restricting means is comprised of a second pin which is protruded from a cylindrical face of the second center shaft, and a second rotation restricting groove with which the second pin is engaged.

By such a configuration, the length of the rotation restricting part for restricting the second center shaft can be made longer. Thus, the error of the setting angle of the second magnetic field generating means is not enlarged as much.

Furthermore, it is preferable that the first center shaft guide groove and the second center shaft guide hole are provided on the same housing.

By such a configuration, the configuration of the first and second rotation restricting means can be made more simple, and the number of elements for constituting the apparatus can be reduced.

Furthermore, it is preferable that the direction of reciprocal movement of the developing electrode crosses an axial standard line linking the rotation axes of the image holder and the developing electrode.

In this configuration, the position of the developing electrode against the image holder can be freely selected.

Furthermore, it is preferable the image forming apparatus further comprises transfer means for transferring a developed image from the surface of the image holder to a surface of a paper sheet and cleaning means disposed for contacting the surface of the image holder and removing the developer remaining on the surface of the image holder.

By such a configuration, the image forming apparatus can be applied to a document copier, laser beam printer, facsimile and so on which use normal paper.

Alternatively, it is preferable that direction of reciprocal movement of the developing electrode is parallel to an axial standard line linking the rotation axes of the image holder and the developing electrode.

Furthermore, it is preferable that the image forming apparatus further comprises transfer means for transferring a developed image from the surface of the image holder to a surface of a paper sheet and cleaning means disposed for contacting the surface of the image holder at a point on the extension of a line linking the rotation axes of the image holder and the developing electrode and removing the developer remaining on the surface of the image holder.

In this configuration, since the contacting parts of cleaning means and the image holder are positioned on the extension of the axial standard line, the direction of the pressing forces from the cleaning means and the pressing means coincide with the direction of the axial standard line. Therefore, the pressing forces from the image holder for pressing the second center shaft can be cancelled. As a result, warping of the second center shaft and second magnetic field generating means can be restricted and the distance from the surface the image holder and second magnetic field generating means can be maintained at a predetermined value.

DETAILED DESCRIPTION OF THE INVENTION

FIRST EMBODIMENT

A first embodiment of an image forming apparatus of this invention is described referring to FIGS. 1 to 4. The developing unit includes elements disposed in the vicinity of a photoconductor and an developing electrode.

Figure 1:
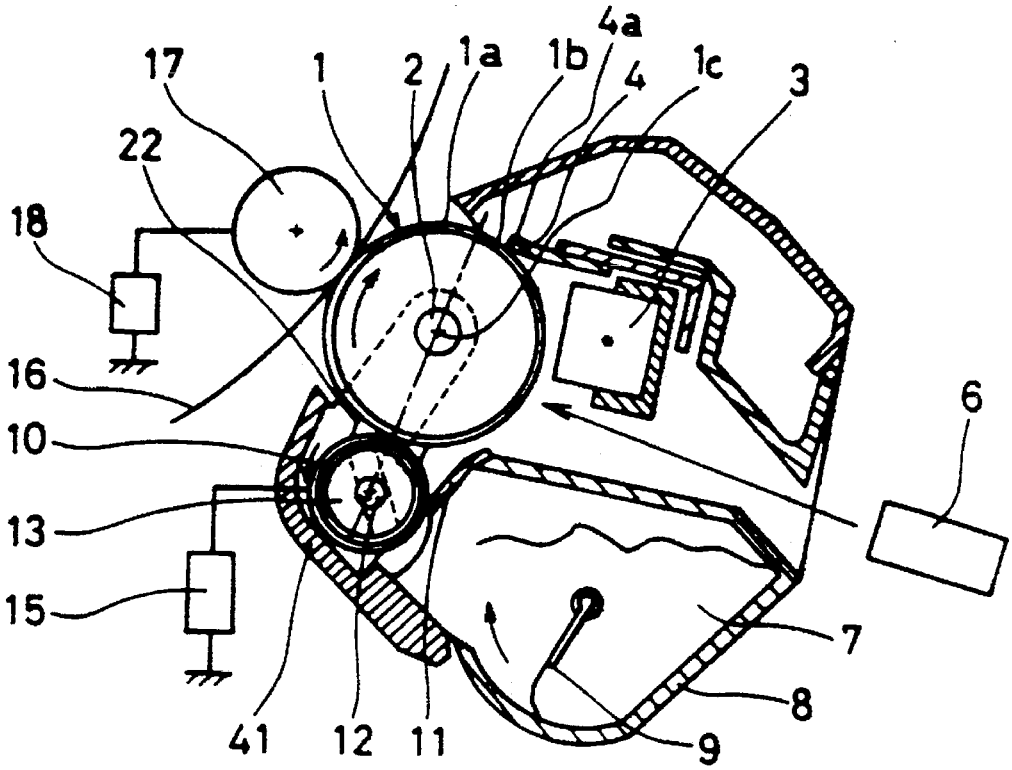
FIG.1 is a sectional side view showing a configuration of the image forming apparatus of the first embodiment.
Figure 2:
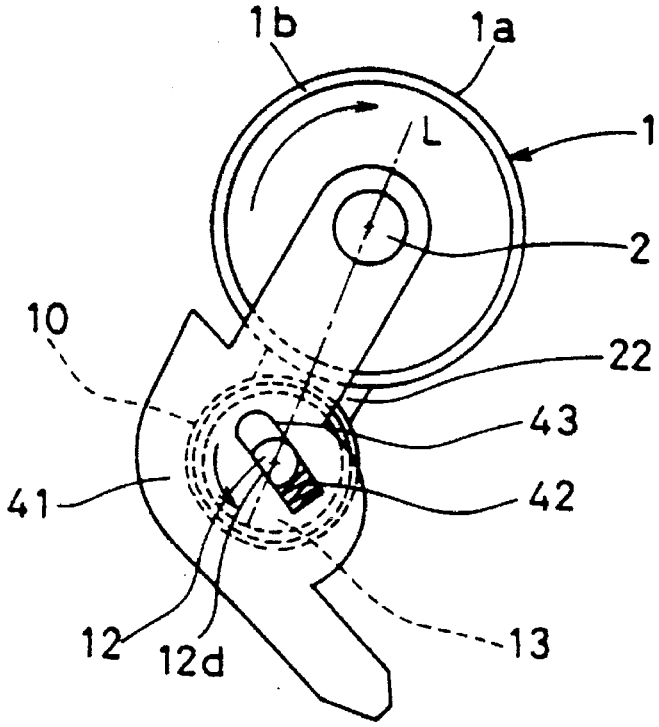
FIG. 2 is an enlarged side view showing a developing unit of the image forming apparatus shown in FIG. 1.

As shown in FIGS. 1 and 2, a photoconductor 1 has a photoconductive layer 1*a* provided on a conductive base member 1*b* of hollow cylinder, and rotates around an axis 1*c* of the hollow cylinder 1*b*. A second center shaft 2, which is not rotatable, is coaxially provided on the axis 1*c* of photoconductor 1.

A charging device 3 which is called Scorotron is disposed in the vicinity of the photoconductor 1 for electrostatically charging the surface of the photoconductive layer 1*a*. A cleaning member 4, which is made of polyurethane rubber and the like, is disposed to contact the photoconductor 1. An end 4*a* of cleaning member 4 is pressed on a surface of the photoconductive layer 1*a* of the photoconductor 1. An exposing device 6 is disposed out of a housing 41 and irradiates a laser beam on the surface of the photoconductive layer 1*a* responding to an image pattern. Magnetic monocomponent toner 7 is contained in a toner hopper 8. A conveyor vane 9 is provided in toner hopper 8 for conveying toner 7 to a developing electrode 10.

Developing electrode 10, which is made of a conductive material and has a hollow cylindrical shape, is disposed to face the photoconductor 1 with a predetermined developing gap in developing nip part where the developing gap between the photoconductor 1 and the developing electrode 10 is the smallest. A gear driving unit (not shown in the figure) is engaged with an end of the developing electrode 10 and the developing electrode 10 is rotated in a predetermined direction. A developing blade 11 is disposed in a manner so that an end of the developing blade 11 is pressed on a surface of the developing electrode 10. A first center shaft 12, which is not rotatable, is coaxially provided with a rotation axis of developing electrode 10. A magnet 13 having a plurality of magnetic poles is integrally fixed on the first center shaft 12.

A developing voltage source 15 applies an alternating developing voltage to the developing electrode 10. In the developing voltage, a D.C. voltage such as −300 V is superimposed on an A.C. voltage in which a voltage from a peak to another peak is, for example, 1.4 kV. A paper sheet 16 is supplied to be pressed on the surface of the photoconductor 1 by a transfer roller 17 so that a toner image is transferred on paper sheet 16. A predetermined transfer voltage is applied to the transfer roller 17 by a transfer voltage source 18. The photoconductor 1, the developing electrode 10, the developing blade 11, and the like, are disposed in a housing 41 of the developing unit.

As shown in FIG. 2, a pressing member 42 such as a coil spring is disposed in a guide groove 43 which is formed on housing 41. Guide groove 43 restricts movement of the first center shaft 12 in a predetermined reciprocal movement. The gap restricting member 22, having a predetermined thickness is provided between the photoconductor 1 and the developing electrode 10 in the vicinity of the developing nip part. The pressing member 42 presses on the first center shaft 12. Thus, the developing electrode 10 is pressed to the photoconductor 1 via the gap restricting member 22. A width of the developing gap between the photoconductor 1 and the developing electrode 10 is defined by the thickness of the gap restricting member 22.

Figure 3:
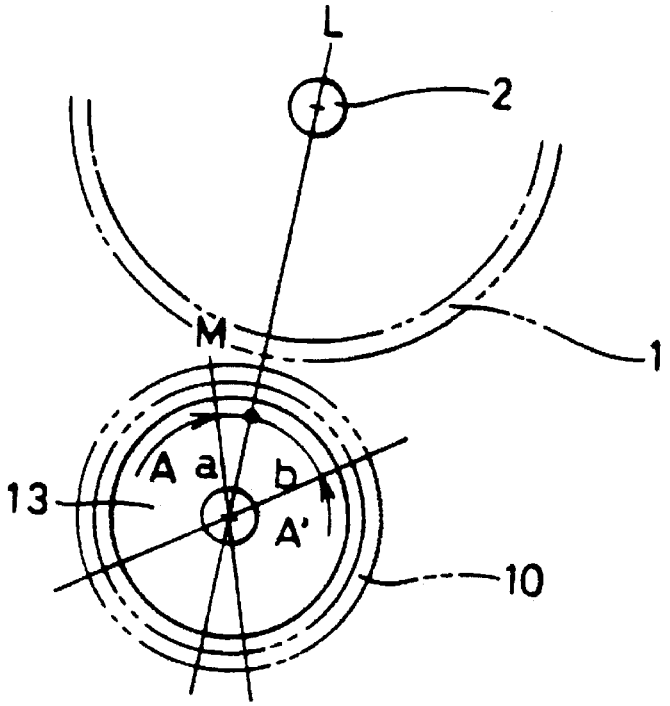
FIG. 3 is a drawing schematically showing an arrangement of magnetic poles.

An arrangement of magnetic poles is shown in FIG. 3. As shown in FIG. 3, a line L is an axial standard line linked between the centers of the first and second center shafts 12 and 2. Magnetic poles a and b generate magnetic flux of north and south poles on the surface of the developing electrode 10. A line M is a center line of magnetic poles showing a direction in which the magnetic pole a generates the largest magnetic flux density on the surface of developing electrode 10.

Figure 4:
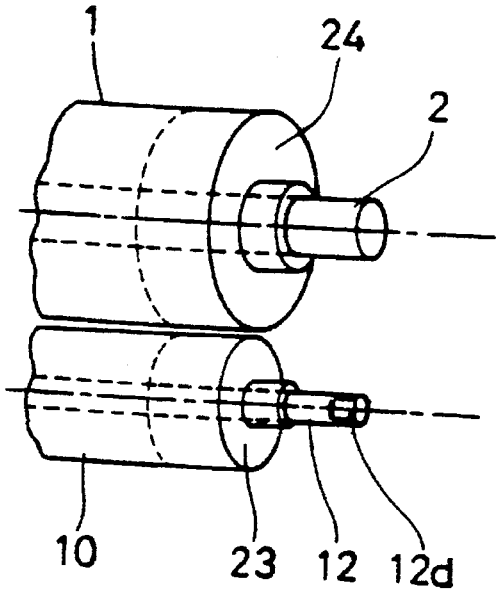
FIG. 4 is a perspective view showing an end part of first and second center shafts in the first embodiment.

A perspective view showing an end part of the first and second center shafts 12 and 2 is shown in FIG. 4. A flange 23 is integrally assembled with the developing electrode 10, and positions the second shaft 12 coaxially on the rotation axis of the developing electrode 10. An inner cylindrical surface of the flange 23 is borne by an outer cylindrical surface of the first center shaft 12, so that the developing electrode 10 can rotate around the first center shaft 12.

The first center shaft 12 has a rotation restricting part 12*d* at an end thereof. The rotation restricting part 12*d* is formed by cutting a part of the cylindrical surface of the first center shaft 12 in a manner to be flat, so that rotation restricting part 12*d* has a substantially D-shaped cross-section in a plane perpendicular to the rotational axis of the developing electrode 10. An angle between the flat face of rotation restricting part 12*d* and line M is set at a predetermined value.

As shown in FIG. 2, housing 41 of the developing unit has a guide groove 43 for guiding the movement of the first center shaft 12. When the flat face of the rotation restricting part 12*d* is guided by a side wall of guide groove 43, error of an angle A of crossing lines M and L can be restricted in a range of ±3 degrees. When crossing angle A is established, another angle A' corresponding to another magnetic pole (shown in FIG. 3) is automatically established.

As shown in FIG. 4, a flange 24 is integrally assembled with the photoconductor 1, and it positions the second center shaft 2 coaxially on the rotational axis of the photoconductor 1. An inner cylindrical surface of the flange 24 is borne by an outer cylindrical surface of the second center shaft 2, so that the photoconductor 1 can rotate around the second center shaft 2. The second center shaft 2 is engaged with and fixed by guide holes formed on the housing 41 of the developing unit.

By the above-mentioned configuration, a magnetic field is generated in the developing nip part of developing electrode 10.

Operation of the image forming apparatus of the first embodiment is described. The operation is divided into two of entire image forming process and developing process for making an electrostatic latent image visible.

At first, image forming process is described. The surface of photoconductor 1 is evenly charged at −500 V by charging device 3. An electrostatic latent image is formed on the surface of the photoconductor 1 by a laser beam of exposing device 6. Toner 7 is adhered on the electrostatic latent image on the photoconductor 1 by an electric field generated in the developing gap by the voltage of the developing voltage source 15. Thus, a toner image is formed on the surface of photoconductor 1.

On the other hand, paper sheet 16 is supplied to a transfer nip part where the photoconductor 1 and the transfer roller 17 are contacted with a predetermined pressure by a paper supplying mechanism (not shown in the figure). The toner image on the surface of the photoconductor 1 is transferred to the paper sheet 16 by an electric field generated in the transfer nip part by a transfer voltage source 18.

The paper sheet 16 holding the toner image will be conveyed to a fixing device (not shown in the figure), and the toner image is fixed on the surface of paper sheet 16 by heat, pressure and so on, by the fixing device. As a result, the final picture image can be formed on paper sheet 16.

Toner, which is not transferred to paper sheet 16 in the transfer nip part and remains on the surface of the photoconductor 1, will reach a contacting part of the cleaning member 4 and the photoconductor 1, and will be removed by cleaning member 4. After that, the above-mentioned processes will be repeated.

Next, the developing process is described. A toner layer, having predetermined amount of toner and electric charge, is formed on the developing electrode 10 by developing blade 11. Since an alternating electric field is generated in the developing nip part by the developing voltage source 15, toner is repeatedly and reciprocally moved in the developing nip part by the alternating electric field. The direction of the electric field formed in an image part of the electrostatic latent image is to be opposite to the direction of electric field in the other non-image part. When the developing is over, the electric field and the magnetic force of the magnet 13 are balanced in a manner so that the toner in the non-image part moves to the developing electrode, and toner in image part moves to the photoconductor 1. Force due to the electric field is determined by the voltage of the developing voltage source 15 and the width of the developing gap. Force due to the magnetic field is determined by the intensity of the magnetic poles, the distance between the magnetic pole and the outer surface of the developing electrode 10 and the setting angle A between the magnetic pole line M and the standard line.

By the above-mentioned configuration, a composed force of electric force and magnetic force can act on the toner in the developing nip part, so that toner is selectively adhered to the image part of the electrostatic latent image. As a result, the toner image responding to the image pattern can be formed on the surface of the photoconductor 1.

In the first embodiment, since the photoconductor 1 and the developing electrode 10 are disposed in a common housing 41, the developing electrode 10 can be positioned precisely against the photoconductor 1. Furthermore, the D-shaped rotation restricting part 12*d* of the first center shaft 12 is guided by the guide groove 43 which is formed on the housing 41 and has substantially the same width as that of the D-shaped rotation restricting part 12*d* from the flat face to a peak of the cylindrical face. By such a configuration, the developing electrode 10 contacts on a face of the gap restricting member 22, and the photoconductor 1 contacts on the opposite face of the gap restricting member 22. The developing gap can thus be maintained at a predetermined distance, corresponding to the thickness of the gap restriction member 22. Furthermore, coaxiality of the developing electrode 10 and the first center shaft 12 with the magnet 13 can be maintained. Thus, even when the center axis of photoconductor 1 or the developing electrode 10 is decentered or deflected, the first center shaft 12 and the fixed magnet 13 are integrally moved, so that the setting angle A of magnetic pole will not be changed. As a result, the magnetic field can be formed stably and certainly in the developing nip part, and a high quality picture image can be formed.

In the developing process, when the width of the developing gap is varied, the intensity of the electric field in the developing gap is also varied. If the developing electrode 10 and the first center shaft 12 were fixed on the housing 41 of the developing unit, and the developing gap was defined by the distance between the first and the second center shafts 12 and 2, the developing gap would be varied by the decentering and deflection. Thus, the intensity of the electric field would be varied and the quality of the picture image would be reduced.

Furthermore, when the distance between the magnet 13 and the developing electrode 10 is varied, the intensity of the magnetic field on the surface of the developing electrode 10 is also varied. Thus, it is important that coaxiality of the magnet 13 and the developing electrode 10 are maintained. If the first center shaft 12 was independently fixed on the housing 41 from the developing electrode 10, and the developing electrode 10 was movably held, the coaxiality of the developing electrode 10 and the magnet 13 would be varied by decentering and deflection of the photoconductor 10 and the developing electrode 10. As a result, the magnetic force in the developing nip part would be varied and the quality of the picture image would be reduced.

In the above-mentioned first embodiment, the second center shaft 2 is provided along the width of the photoconductor 1. However, it is possible that second center shaft 2 is divided into two parts for supporting the photoconductor 1 at both ends thereof. Furthermore, the rotation restricting part 12*d* having D-shaped cross-section is provided at one end of the first center shaft 12. However, it is possible to provide the rotation restricting part at more than two parts. Furthermore, number of magnetic poles on the magnet 13 in developing electrode 10 can be made to be more than two.

SECOND EMBODIMENT

Figure 5:
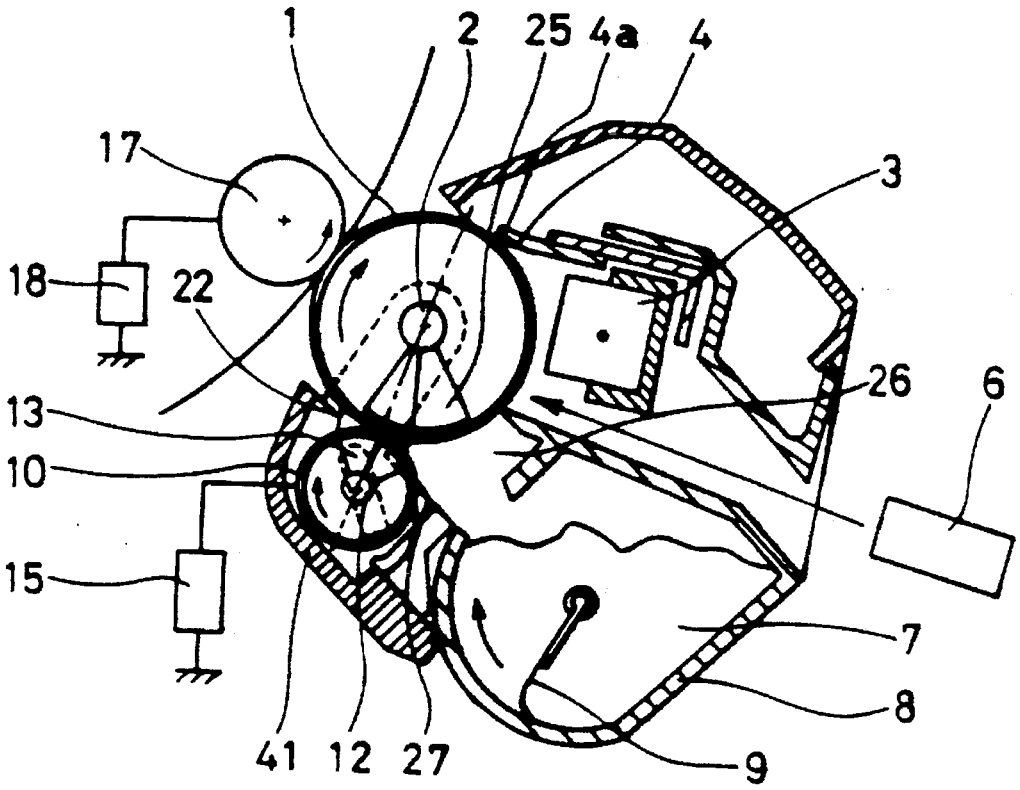
FIG. 5 is a sectional side view showing a configuration of the image forming apparatus of the second embodiment.
Figure 6:
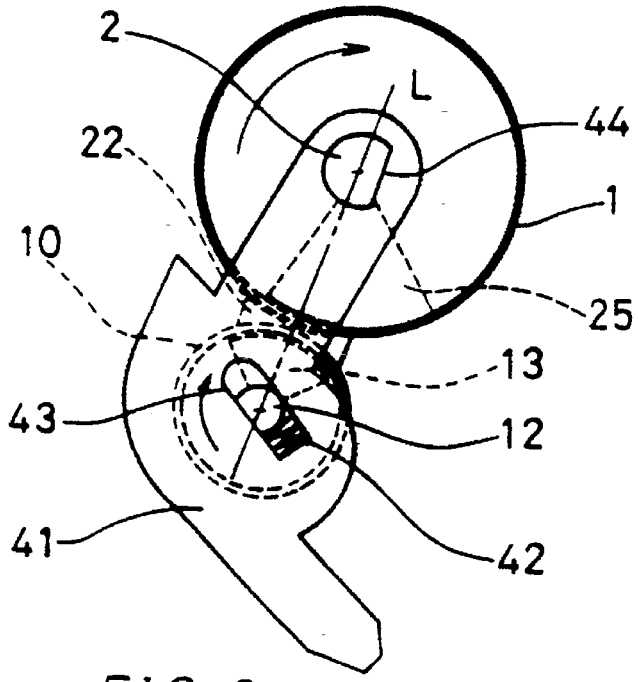
FIG. 6 is an enlarged side view showing a developing unit of the image forming apparatus shown in FIG. 5.

A second embodiment of an image forming apparatus of this invention is described referring to FIGS. 5 to 8. A sectional side view showing a configuration of the image forming apparatus of the second embodiment is shown in FIG. 5 and an enlarged side view showing a developing unit of the image forming apparatus is shown in FIG. 6. In the second embodiment, elements designated by the same numerals as those of the above-mentioned first embodiment are substantially the same. Thus, different points from the first embodiment are described.

The second center shaft 2, which is not rotatable, is coaxially provided on the rotation axis of photoconductor 1. A magnet 25 is integrally fixed on second center shaft 2. A developing electrode 10, which is made of a conductive material and has a hollow cylindrical shape, is disposed to face photoconductor 1 with a predetermined developing gap by the gap restricting member 22 in the developing nip part. A gear driving unit (not shown in the figure) is engaged with an end of the developing electrode 10 and the developing electrode 10 is rotated in a same direction as the rotation direction of the photoconductor 1 as shown in FIG. 5. Instead of developing blade 11, as in the first embodiment, a toner accumulator 26 and a scraper 27 are provided in the same place. Scraper 27 is made of, for example, phosphor bronze plate, and an end of scraper 27 is pressed on the surface of developing electrode 10. A first center shaft 12, which is not rotatable, is coaxially provided with a rotation axis of the developing electrode 10. A magnet 13 is integrally formed with the first center shaft 12. A cleaning member 4 which is made of polyurethane rubber or the like, is provided to contact the photoconductor 1. An end 4*a* of the cleaning member 4 is pressed on the surface of the photoconductor 1. The photoconductor 1, the developing electrode 10, the scraper 27, the toner accumulator 26, the toner hopper 8 etc., are disposed in a housing 41 of the developing unit.

A developing voltage source 15 applies an alternating developing voltage to the developing electrode 10. A D.C. voltage such as −250 V is superimposed on an A.C. voltage in the developing voltage, in which a voltage between the peaks is, for example, 1.4 kV. A width of the developing gap between the photoconductor 1 and the developing electrode 10 is maintained at 200 μm by the gap restricting member 22.

Other configuration which are not explained above and the entire image forming process of the second embodiment are substantially the same as those of the first embodiment.

Figure 7:
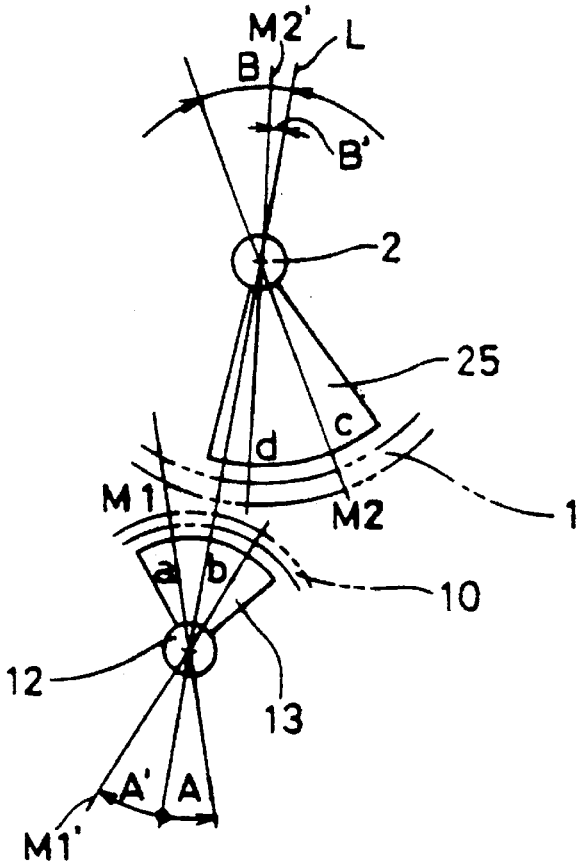
FIG. 7 shows an arrangement of photoconductor, developing electrode, and magnets in the second embodiment.

Next, a configuration for generating a magnetic field is described referring to FIG. 7. FIG. 7 shows an arrangement of the photoconductor 1, the developing electrode 10, and the magnets 13 and 25. With respect to the magnet 25 in the photoconductor 1, a magnetic pole c is a south pole and a magnetic pole d is a north pole. With respect to the magnet 13 in the developing electrode 10, a magnetic pole a is a north pole and a magnetic pole b is a south pole. Magnetic poles c and d are respectively positioned at the upstream part in the rotation direction of the photoconductor 1 from the standard line L. The largest magnetic flux of the magnetic pole c is in a range from 620 to 700 G. An angle B of crossing lines L and M2 is 35 degrees. The largest magnetic flux of the magnetic pole d is in a range from 440 to 530 G. An angle B' of crossing lines L and M2' is 5 degrees. The largest magnetic flux of the magnetic pole a is in a range from 550 to 630 G. An angle A of crossing lines L and M1 is 20 degrees. The largest magnetic flux of the magnetic pole b is in a range of 380 to 470 G. An angle A' of the crossing lines L and M1' is 20 degrees. The intensity of the magnetic flux are respectively measured on the surfaces of photoconductor 1 or developing electrode 10 independent from another.

By the above-mentioned configuration, magnetic fields are generated in the developing nip parts of the developing electrode 10 and the photoconductor 1 which are opposed to each other. Since the two magnetic fields face in a short distance, the shapes of the magnetic fields are defined by a balance of several parameters. Therefore, the effects of each parameter to the shapes of the magnetic fields are larger than when each parameter exists independently.

Figure 8:
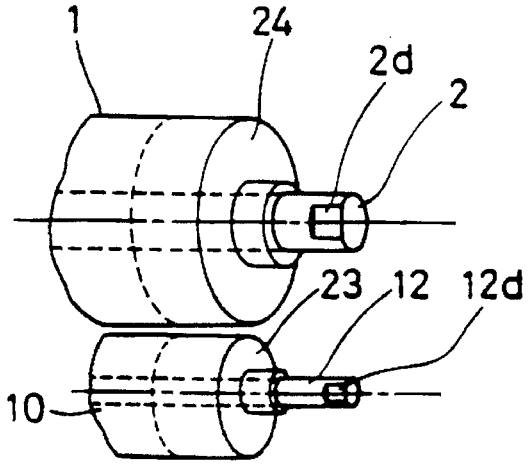
FIG. 8 is a perspective view showing an end part of first and second center shafts in the second embodiment.

A perspective view showing an end part of the first and second center shafts 12 and 2 is shown in FIG. 8. A flange 23 is integrally assembled with the developing electrode 10, and positions the first center shaft 12 coaxially on the rotation axis of the developing electrode 10. An inner cylindrical surface of the flange 23 is borne by an outer cylindrical surface of the first center shaft 12, so that the developing electrode 10 can rotate around the first center shaft 12.

First center shaft 12 has a rotation restricting part 12*d* at an end thereof. Rotation restricting part 12*d* is formed by cutting a part of the cylindrical surface of the first center shaft 12 in a manner to be flat, so that the rotation restricting part 12*d* has a substantially D-shaped cross-section in a plane perpendicular to the rotation axis of the developing electrode 10. An angle between the flat face of the rotation restricting part 12*d* and the line M1 is set at a predetermined value.

As shown in FIG. 6, the housing 41 of the developing unit has a guide groove 43 for guiding the movement of the first center shaft 12. When the flat face of the rotation restricting part 12*d* is guided by a side wall of the guide groove 43, the error of angle A between lines M1 and L can be restricted in a range of ±3 degrees. By such a configuration, a magnetic field is generated on the surface of the developing electrode 10.

As shown in FIG. 8, a flange 24 is integrally assembled with the photoconductor 1. An inner cylindrical surface of the flange 24 is borne by an outer cylindrical surface of the second center shaft 2, so that the photoconductor 1 can rotate around the second center shaft 2.

Second center shaft 2 has a rotation restricting part 2*d* at an end thereof. The rotation restricting part 2*d* is formed by cutting a part of the cylindrical surface of the second center shaft 2 in a manner to be flat, so that the rotation restricting part 2*d* has a substantially D-shaped cross-section in a plane perpendicular to the rotation axis of the photoconductor 1. An angle between the flat face of the rotation restricting part 2*d* and line M2 is set at a predetermined value. The second center shaft 2 is engaged with and fixed by a guide hole 44 having the same shape as the D-shape of the rotation restricting part 2*d* and formed on housing 41 of the developing unit. Error of an angle B between lines M2 and L can be restricted in a range of ±3° degrees. By such a configuration, a magnetic field is generated in the developing nip part of the photoconductor 1.

Next, a developing process of an electrostatic latent image by toner is described. At first, toner 7 in toner hopper 8 is supplied to the toner accumulator 26 by rotation of a transfer vane 9. Toner supplied in the toner accumulator 26 receives magnetic force by magnet 25, and adheres evenly on the surface of the photoconductor 1 with no relation to the electrostatic latent image. Toner adhered on the surface of the photoconductor 1 is carried to a portion in the vicinity of the developing nip part by the rotation of the photoconductor 1 under the influence of the magnetic force generated on the surface of photoconductor 1.

An amount of toner carried in the developing nip part is defined by the balance of magnetic forces due to magnets 13 and 25. An alternating electric field is generated in the developing nip part by the developing voltage source 15. Toner is reciprocally moved in the developing nip part by the alternating electric field. The D.C. voltage which is superimposed on the A.C. voltage is applied in a manner so that the electric field generated in an image part of the electrostatic latent image becomes opposite to the direction of the electric field formed in the other non-image part of the electrostatic latent image. When the developing operation is over, the electric force and the magnetic forces due to magnets 13 and 25 are balanced in a manner so that the toner in the non-image part moves to the developing electrode and toner in the image part adheres on the photoconductor 1.

Force due to the electric field is defined by the voltage of the developing voltage source 15 and the width of the developing gap. Force due to the magnetic field is defined by the intensity of the magnetic poles, the coaxiality of magnet 25 and the photoconductor 1, the coaxiality of magnet 13 and the developing electrode 10, the distance between the magnets 13 and 25, and the positions of the magnetic poles a to d. Especially, the two magnets 13 and 25, and the four magnetic poles are opposed, so that a change of one parameter largely effects the entire magnetic field.

By the above-mentioned configuration, the combined force of magnetic force and electric force can act on the toner during the reciprocal motion in the developing nip part. Thus, toner selectively adheres on the image part of the electrostatic latent image, and a toner image is formed responding to the image pattern.

On the other hand, toner in the non-image part receives electric force and magnetic force due to magnet 13, and adheres on the developing electrode 10. Toner on the developing electrode 10 reaches the toner accumulator 26 by the rotation of the developing electrode 10, and it is withdrawn by the scraper 27. The withdrawn toner is used for forming another picture image by adhering to the surface of the photoconductor 1, again.

By such a developing process, all the patterns of the electric charge un photoconductor 1 can be made visible under the largest S/N ratio of the image part against the non-image part. Furthermore, toner in the non-image part can be removed effectively. Therefore, a high resolution picture image can be obtained.

In the second embodiment, the photoconductor 1 and the developing electrode 10 are pressed via the gap restricting member 22, so that the developing gap can be maintained at a predetermined distance corresponding to the thickness of the gap restricting member 22. When the photoconductor 1 and the developing electrode 10 having decentering and deflection are rotated, the distance between the axes of the first and the second center shafts 12 and 2 must be adjusted. At this time, first center shaft 12 slides in the guide groove 43. Since the flat face of D-shaped rotation restricting part 12*d* of the first center shaft 12 slides on a side wall of the guide groove 43, the movement of the first center shaft 12 is restricted in reciprocal movement along the guide groove 43.

Figure 9:
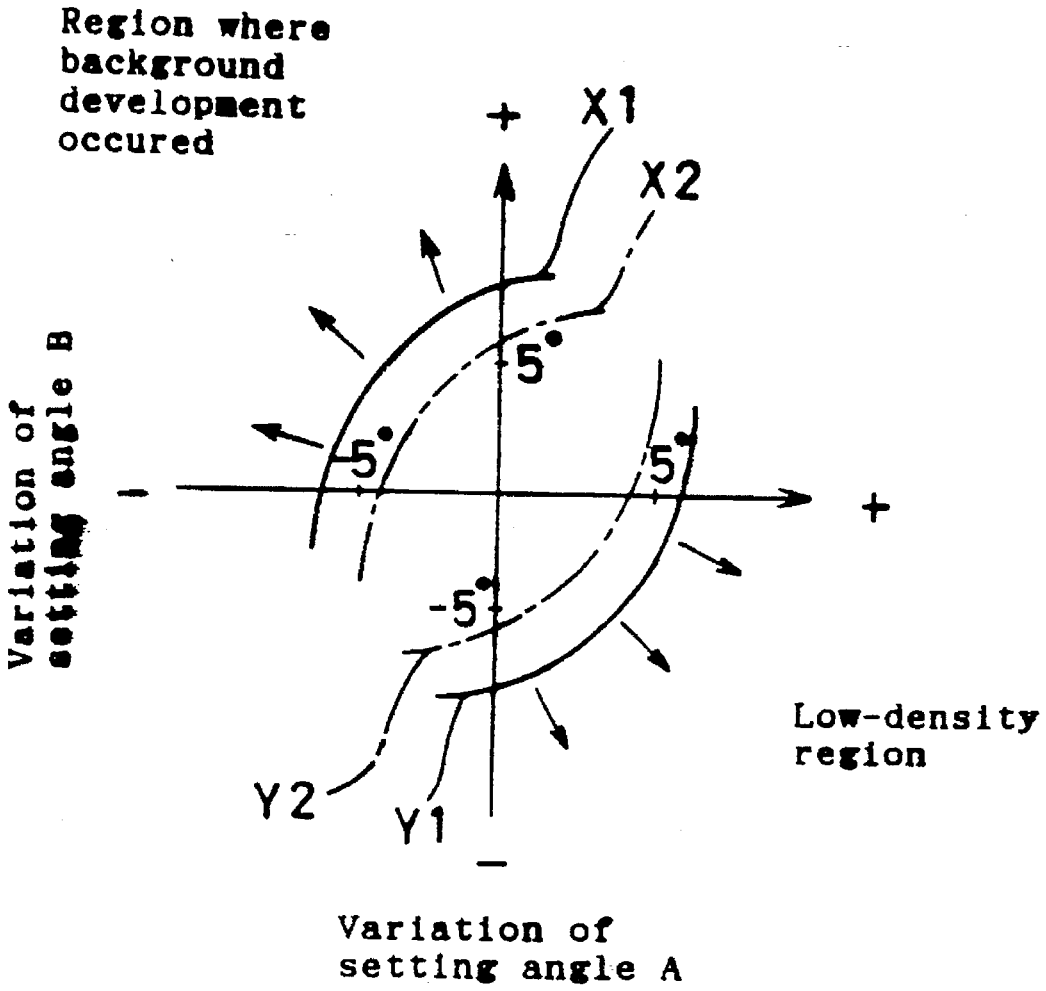
FIG. 9 is a drawing schematically showing change of the quality of the picture images which were obtained by such developing process.

In the developing process of the second embodiment, the developing gap was changed and the magnet 13 was independently moved from the rotation center of the developing electrode 10. Furthermore, the angle B of the magnet 25 and the angle A of the magnet 13 were changed. At this time, the change of the quality of the picture images which were obtained by such developing process is shown in FIG. 9. The abscissa designates the change of the setting angle of magnet 25, and the ordinate designates the change of the setting angle of magnet 13. The origin designates the original set value of the setting angles of magnets 13 and 25. The plus signs designate directions of rotation of the photoconductor 1 or the developing electrode 10 in upstream parts.

In FIG. 9, curved real lines X1 and Y1 respectively show contour lines of the gradation of the picture image and the boundary of the occurrence of background development under a condition that the width of the developing gap was 200 μm and magnet 13 was disposed coaxially with the rotation axis of the developing electrode 10. One dotted chain line X2 shows a boundary of the occurrence of background development under another condition that the developing gap was expanded to 250 μm. One dotted chain line Y2 shows a contour line of the gradation of the picture image under a condition that magnet 13 is disposed at a position distant 0.25 mm from the rotation axis of the developing electrode 10 to the photoconductor 1.

With respect to the gradation, a region lower than 1.35 was defined as low density. A region designated by arrows in the lower-right portion in the figure was a low density region. In a region designated by arrows in the upper-left portion in the figure, background development, which was the adhesion of developer such as toner on the paper sheet in the non-image part of the picture image, occurred. The one-dotted chain line X2 was a boundary between the regions where background development occurred or did not occur. The one-dotted chain line Y2 was a boundary between the regions where the density of the gradation was above 1.35 or below 1.35.

From FIG. 9, it was found that the coaxiality of the magnet 13 and the developing electrode 10 was important with respect to a phenomenon that the contour line of the density was moved from line Y1 to Y2. It was considered that this phenomenon was caused by varying the magnetic field in the developing nip part due to the changes of the distances between the magnet 13 and the developing electrode 10 and between the magnets 13 and 25. Accordingly, if the first center shaft 12 were independently fixed on the housing or frame of the developing unit from the developing electrode and only the developing electrode were movable, the relative positions of the developing electrode 10 and the magnet 13 were varied due to the decentering and deflection of the photoconductor 1 and the developing electrode 10. As a result, the balance of magnetic force and electric force in the developing nip part were damaged and quality of the picture image were reduced.

Furthermore it was found that the width of the developing gap was important with respect to a phenomenon that the boundary of occurrence of background development was moved from line X1 to X2. It was considered that this phenomenon was caused by the varying of the intensity of electric field caused by the change of the distance between the photoconductor 1 and the developing electrode 10. Accordingly, if the developing electrode was fixed on a housing of frame of the developing unit with the first center shaft 12, and the width of the developing gap was defined by the distance between the first and second center shafts 12 and 2, the width of the developing gap was varied by the decentering and deflection of the photoconductor 1 and the developing electrode 10. As a result, the balance of magnetic force and electric force in the developing nip part was damaged and the quality of the picture image were reduced.

In the above-mentioned second embodiment, the guide hole 44 for supporting the second center shaft 2 and setting the angle of magnet 25 is provided on housing 41 of the developing unit, and the guide groove 43 for guiding the movement of the first center shaft 12 is also provided on housing 41. Thus, the relative position of the second center shaft 2 against first center shaft 12 and the setting angle of magnet 25 can precisely be set. Furthermore, the D-shaped rotation restricting part 12*d* of the first center shaft 12 is guided by the guide groove 43 which is formed on the housing 41 and has substantially the same width as that of the D-shaped rotation restricting part 12*d* from the flat face to a peak of the cylindrical face. By such a configuration, the developing electrode 10 contacts a face of the gap restricting member 22, and the photoconductor 1 also contacts on the opposite face of the gap restricting member 22. The developing gap can be maintained at a predetermined distance corresponding to the thickness of the gap restriction member 22. Furthermore, coaxiality of the developing electrode 10 and the first center shaft 12 with the magnet 13 can be maintained. Thus, even when the center axis of the photoconductor 1 or the developing electrode 10 has been decentered or deflected, the first center shaft 12 and the fixed magnet 13 are integrally moved, so that the setting angle A of the magnetic pole may not be changed. As a result, the magnetic field can be formed stably and with certainty in the developing nip part, and a high quality picture image can be formed.

THIRD EMBODIMENT

Figure 10:
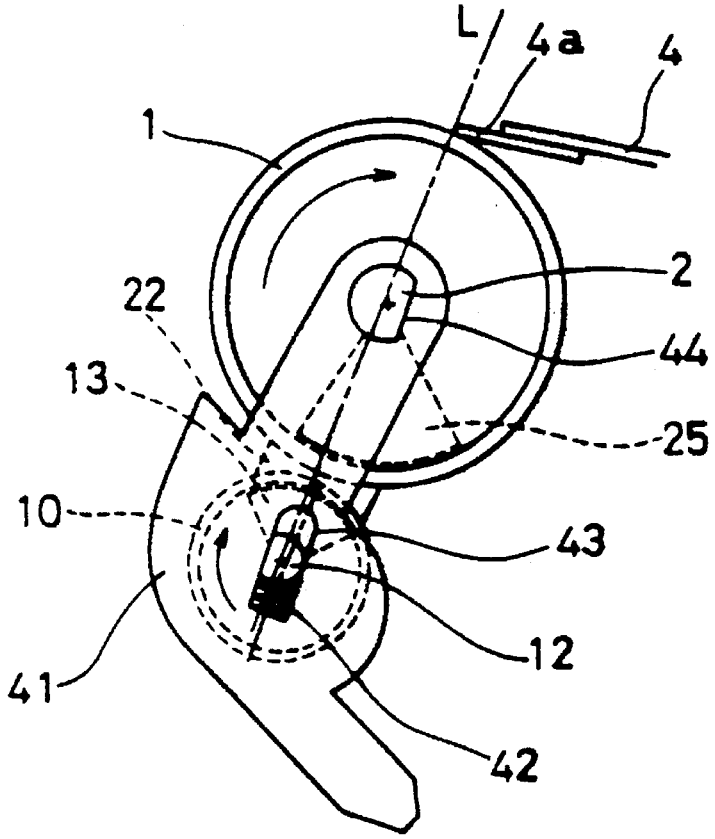
FIG. 10 is an enlarged side view showing a configuration of developing unit of an image forming apparatus of the third embodiment.
Figure 11:
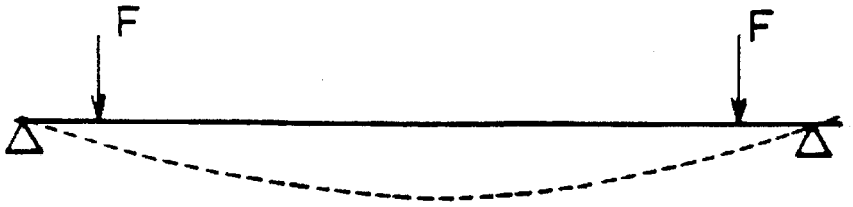
FIG. 11 is a drawing schematically showing a bending moment on a shaft at four points of both ends of the shaft and flange parts.

A third embodiment of an image forming apparatus of this invention is described referring to FIGS. 10 and 11. An enlarged side view showing a configuration of a developing unit of an image forming apparatus of the third embodiment is shown in FIG. 10. In the third embodiment, elements designated by the same numerals as those of the above-mentioned second embodiment are substantially the same. Thus, different points from the second embodiment are described.

As shown in FIG. 10, a direction of the center line of the guide groove 43 on housing 41 in the lengthwise direction is substantially parallel to the axial standard line L linking the rotation axes of the photoconductor 1 and the developing electrode 10. End 4*a* of the cleaning member 4 contacts the surface of photoconductor 1 at a point positioned on the extension of the axial standard line L. By such a configuration, the direction of a composed force of pressure due to the cleaning member 4 and the pressing force by the pressing member 42 is coincident with the direction of the axial standard line L.

In the second embodiment shown in FIG. 6, the setting angle of the magnet 13 is a constant when the magnet reciprocally moves. However, the center line of the guide groove 43 on the housing 41 in the lengthwise direction inclines against the axial standard line L, and they are not in the same direction. If the movement of the first center shaft 12 were much larger, the axial standard line L which is to be the standard, would be rotated largely. Thus, there is a possibility that the setting position of the magnetic pole against the developing nip part would be displaced by the reciprocal movement of the magnet 13. As a result, the magnetic field generated in the developing nip part would be varied, and the quality of picture image would be reduced.

Furthermore, the pressing members 42 press the photoconductor 1 at both ends thereof via the developing electrode 10 and the gap restricting member 22. On the other hand, the cleaning member 4 presses the photoconductor in the opposite direction. As shown in FIG. 11, the second center shaft 2 receives a bending moment due to a combined force of the pressure by the pressing members 42 and the cleaning member 4 at four points of both ends of the second center shaft 2 and the flange parts 24 of the photoconductor 1. As a result, the second center shaft 2 and the magnet 25 are warped as shown by dotted line in FIG. 11. The distance from the surface of the photoconductor 1 and the magnet 25 varies in the lengthwise direction of the cylindrical shape of the photoconductor 1.

In the above-mentioned configuration of the third embodiment, the flat face of D-shaped rotation restricting part 12*d* of the first center shaft 12 slides along the side wall of the guide groove 43. Thus, the first center shaft 12 and the magnet 13 can reciprocally be moved along the axial standard line L while maintaining a predetermined setting angle of the magnet 13. The developing electrode 10 contacts the gap restricting member 22, and the gap restricting member 22 contacts the photoconductor 1, so that the width of the developing gap can be maintained at a predetermined value, corresponding to the thickness of the gap restricting member 22. Furthermore, the developing electrode 10, the magnet 13 and the first center shaft 12 can integrally be moved along the axial standard line L. Thus, even when the photoconductor 1 and the developing electrode 10 are decentered and deflected, the setting angle of the magnet 13 will not be varied, because the first center shaft 12 and the magnet 13 reciprocally move along the axial standard line L.

Furthermore, since the contacting part of the cleaning member 4 and the photoconductor 1 is positioned on the extension of the axial standard line L, the direction of the combined force of pressing force due to cleaning member 4 and the pressing members 42, coincide with the direction of the axial standard line L. Therefore, the pressing forces due to flanges 24 of photoconductor 1 for pressing against the second center shaft 2 can be cancelled. As a result, the warp of the second center shaft 2 and the magnet 25 can be restricted and the distance from the surface of the photoconductor 1 and the magnet 25 can be maintained at a predetermined value. A predetermined magnetic field can be generated in the developing nip part consistently, and a high quality picture image can be obtained.

In the third embodiment, as forces acting on photoconductor 1, pressing forces of pressing members 42 and cleaning member 4 are considered. However, when the pressures due to transfer roller, charging roller and the like are much larger, it is preferable to make a combined force of these pressures the smallest value.

FOURTH EMBODIMENT

Figure 12:
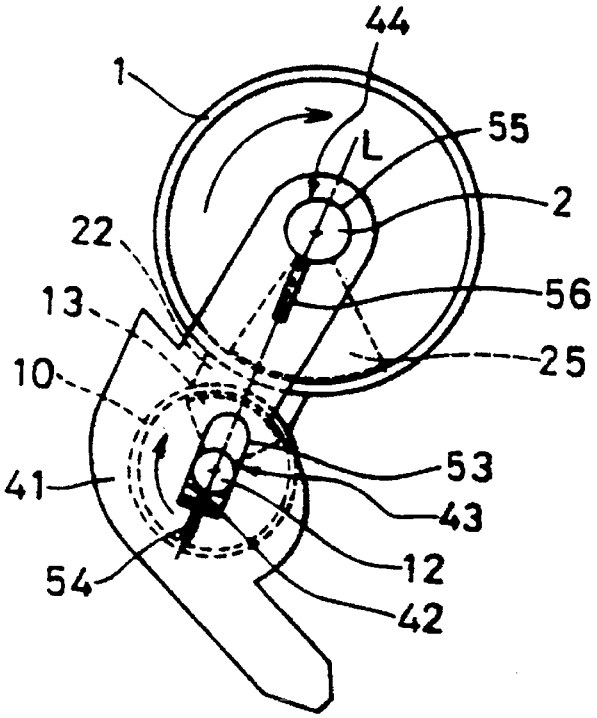
FIG. 12 is a sectional side view showing a configuration of the image forming apparatus of the fourth embodiment.
Figure 13:
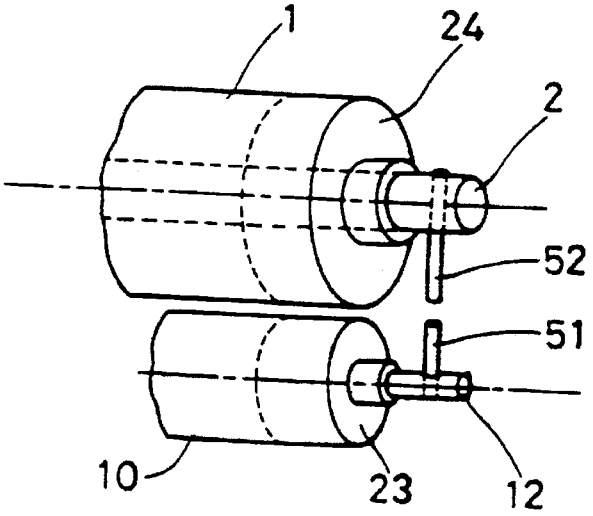
FIG. 13 is an enlarged side view showing a developing unit of the image forming apparatus shown in FIG. 12.

A fourth embodiment of an image forming apparatus of this invention is described referring to FIGS. 12 and 13. A sectional side view showing a configuration of the image forming apparatus of the fourth embodiment is shown in FIG. 12, and an enlarged side view showing a developing unit of the image forming apparatus is shown in FIG. 13. In the fourth embodiment, elements designated by the same numerals as those of the above-mentioned third embodiment are substantially the same. Thus, different points from the third embodiment are described.

As shown in FIG. 12, the guide groove 43 formed on the housing 41 of the developing unit is comprised of a guide part 53 and an angle restricting part 54. Similarly, the guide hole 44 is comprised of a positioning part 55 and an angle restricting part 56. The angle restricting parts 54 and 56 are respectively directed parallel to the axial standard line L. On the other hand, as shown in FIG. 13, cylindrical pins 51 and 52 are respectively inserted in the first and the second center shafts 12 and 2 in a direction perpendicular to the center axes.

The second center shaft 2 is inserted into the positioning part 55, and the pin 52 is inserted into the angle restricting part 56. When an outer surface of the pin 2 contacts an inner wall of the angle restricting part 56, the second center shaft 2 is fixed on the housing 41. The first center shaft 12 is inserted into the guide part 53, and the pin 54 is inserted into the angle restricting part 54. The first center shaft 12 and the pin 51 integrally slide on the inner walls of the guide part 53 and the angle restricting part 54. The inner walls of the guide part 53 and the angle restricting part 54 are disposed parallel to the axial standard line L, so that the magnet 13 which is integrally fixed on the first center shaft 12 can be moved while maintaining the setting angle A at a predetermined angle.

In the above-mentioned second embodiment shown in FIG. 6, or in the third embodiment shown in FIG. 10, the angle of the second center shaft 2 or first center shaft 12 is restricted by contact of the flat face of D-shaped angle restricting part **2*d* or 12*d* with the side wall of the guide hole 44 or the guide groove 43. If a length of the contacting part along the side wall is much shorter, the error of angle of the flat face is enlarged in the setting angle of magnetic poles of the magnet fixed on the first or second center shaft 2 or 12. Furthermore, since a diameter of the first center shaft 12 is smaller than that of the second center shaft 2**, error of the setting angle of magnetic poles will be the important matter.

Because the first center shaft 12 slides on the side wall of guide groove 43, a predetermined clearance is necessary between the guide groove 43 and the first center shaft 12 in order to reduce the friction resistance between them. If the clearance between guide groove 43 and first center shaft 12 is much larger, however, the angular restriction of first center shaft 12 by the D-shaped angle restricting part **12*d*** is deteriorated and a large error in the setting angle of magnetic poles appears.

Furthermore, in the image forming apparatus, a diameter of the photoconductor 1 is generally larger than that of the developing electrode 10. Thus, the magnet 25 which is to be provided in the photoconductor 1 is made larger than the magnet 13 which is to be provided in the developing electrode 10. If the setting angle B of the magnet 25 shown in FIG. 7 were varied by 1 degree, variation of the magnetic flux generated in the developing nip part would be much larger than if the setting angle A of the magnet 13 were varied by 1 degree. Therefore, it is necessary to adjusting the setting angle B of the magnet 25 more precisely.

Furthermore, the first center shaft 12 slides in the guide groove 43 while being restricted from rotating by the D-shaped rotation restricting part 12. If a large external force, such as rotation driving force, were applied to the first center shaft 12, the contacting face of the flat face of D-letter-shaped rotation restricting part **12*d* and the side wall of the guide groove 43 would be worn away. The wear of the flat face or the side wall would cause variation in the setting angle of the first center shaft 12 and the magnet 13**.

However, in the fourth embodiment configured above, the rotation of the magnet 25 against the rotation axis of the photoconductor 1 is restricted by the pin 52 which protrudes from the outer face of the second center shaft 2, so that the length of the part for restricting rotation of the magnet 25 or the second center shaft 2 can be made longer. Thus, error in the setting angle B of the magnet 25, as shown in FIG. 7, could not be as enlarged, even if there was an error in the setting angle of the magnet. Similarly, the rotation of the magnet 13 against the rotation axis of the developing electrode 10 is restricted by the pin 51 which protrudes from the outer face of the first center shaft 12, so that the setting angle A of the magnet 13, as shown in FIG. 7 can precisely be restricted. Especially, the setting angle A of the magnet 13 can be set precisely, even though a predetermined clearance is provided between the pin 51 and the angle restricting part 54 of the guide groove 43.

Furthermore, the surface for restricting the setting angle of the first center shaft 12 and the surface for guiding the reciprocal movement of the first center shaft 12 are different. The external force, such as rotation driving force acting on the first center shaft 12, is received by the guide part 53. Force acting on the angle restricting part 54 is only the reaction force for restricting the rotation of the first center shaft 12. Thus, the pin 51 can be slid under a low load. As a result, the variation of the setting angle of the magnet 13 due to wear can be prevented.

By the above-mentioned configuration, the setting angles A and B of the magnets 13 and 25 can be set precisely, and a predetermined magnetic field can be generated in the developing nip part accurately.

FIFTH EMBODIMENT

Figure 14:
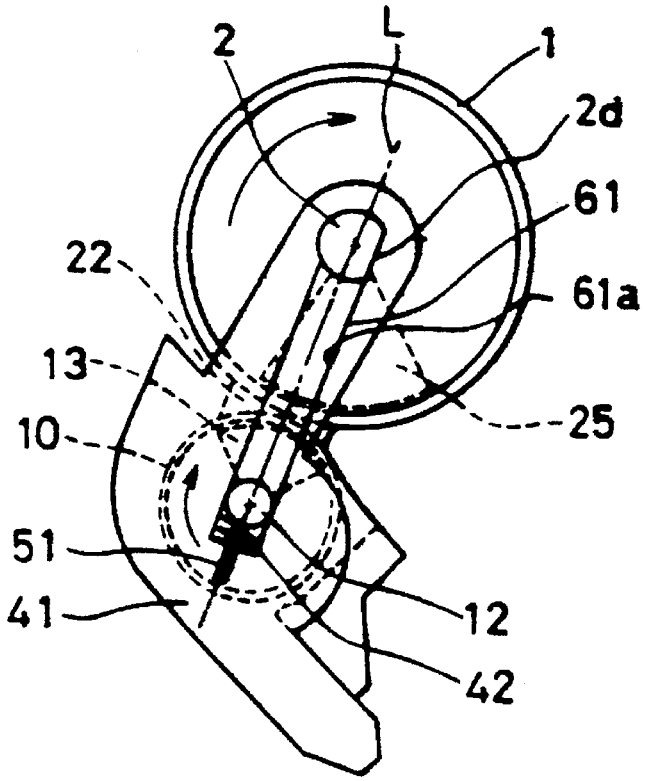
FIG. 14 is an enlarged side view showing a configuration of developing unit of an image forming apparatus of the fifth embodiment.

A fifth embodiment of an image forming apparatus of this invention is described referring to FIG. 14 which is an enlarged side view showing a configuration of developing unit of an image forming apparatus of the fifth embodiment. In the fifth embodiment, elements designated by the same numerals as those of the above-mentioned third or fourth embodiment are substantially the same. Thus, different points from the third or fourth embodiment are described.

As shown in FIG. 14, a guide groove 61 which is substantially the integration of the guide part 53 of the guide groove 43 and the guide hole 44 in the fourth embodiment is provided on the housing 41 of the developing unit. A pair of side walls of the guide groove 61 are parallel to the axial standard line L, and the flat face of the D-shaped rotation restricting part **2*d* of second center shaft 2 and the first center shaft 12 are guided by the same side wall 61*a*. A distance from the center axis of the first center shaft 12 to the flat face of the rotation restricting part 12*d* corresponds to a radius of the first center shaft 12**.

The second center shaft 2 is held on the housing 41 and the rotation of the second center shaft 2 is restricted by engaging the rotation restricting part 2*d* with the guide groove 61, similar to the third embodiment. The developing electrode 10 is pressed on the gap restricting member 22 by the pressing member 42. The gap restricting member 22 contacts the photoconductor 1 by the pressing force due to the pressing member 42. The rotation of the first center shaft 12 is restricted by the contacting pin 51 on the side wall of the rotation restricting part 54. The first center shaft 12 reciprocally slides on the side walls of the guide groove 61.

In the fifth embodiment configured above, the rotation of the second center shaft 2 and the reciprocal movement of the first center shaft 12 are guided by the same side walls of the guide groove 61, so that the moving direction of the first center shaft 12 is precisely restricted to be parallel to the axial standard line L. As a result, a predetermined magnetic flux can be generated in the developing nip by the magnets 13 and 25 which are respectively fixed on the first and second center shafts 12 and 2.

SIXTH EMBODIMENT

Figure 15:
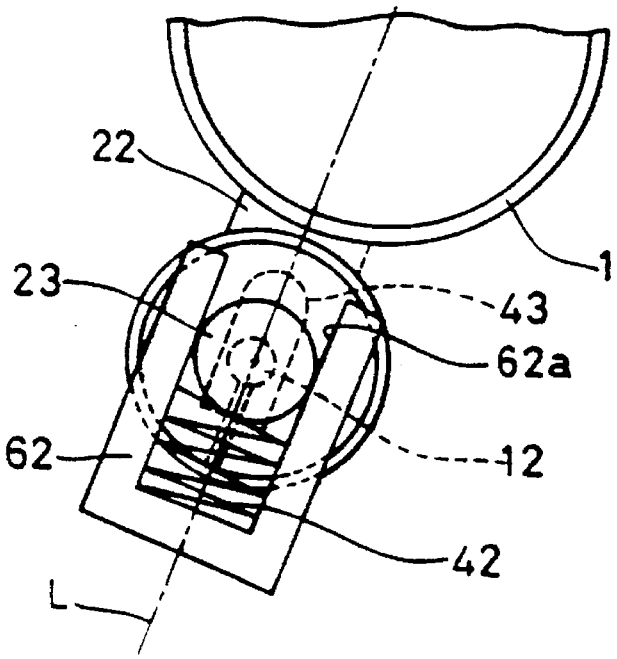
FIG. 15 is an enlarged side view showing a configuration of developing unit of an image forming apparatus of the sixth embodiment.

A sixth embodiment of an image forming apparatus of this invention is described referring to FIG. 15, which is an enlarged side view showing a configuration of a developing unit of an image forming apparatus of the sixth embodiment. In the sixth embodiment, elements designated by the same numerals as those of the above-mentioned fourth embodiment are substantially the same. Thus, different points from the fourth embodiment are described.

As shown in FIG. 15, an electrode restricting member 62 having a guide groove 62*a* is provided in the vicinity of an end of the developing electrode 10. Guide groove 62*a* has a width which is substantially the same as a diameter of a protruded part of the flange 23. The protruded part of flange 23 is guided by and slides on the side walls of guide groove 62*a*. Pressing member 42 is disposed in the guide groove 62*a* and presses against the protruded part of the flange 23. The direction of the side walls of the guide groove 62*a* is parallel to the axial standard line L, so that the developing electrode 10 is pressed against the photoconductor 1 via the gap restricting member 22. Clearance between the first center shaft 12 and the side walls of the guide groove 43 provided on the housing 41 of developing unit can be made larger, since the position of the first center shaft 12 is defined by the engagement of the protruded part of the flange 23 of developing electrode 10 and the side walls of guide groove 62*a*.

In the above-mentioned fifth embodiment, the first center shaft 12 receives a bending moment due to the pressure of the pressing members 42 acting on both ends of the first center shaft 12 and the reaction forces from the gap restricting member 22 at the flange parts 23 of the developing electrode 10. Furthermore, a force composed of external forces, such as the driving force from the gear driving mechanism, and the pressure of scraper 27, acts on the developing electrode 10 in a direction perpendicular to the rotation axis of the developing electrode 10. If the external forces were much larger, the first center shaft 12 would receive a large bending moment at four points of flange parts 23 and guide grooves 43 in the vicinity of both ends of the first center shaft 12. As a result, the first center shaft 12 and the magnet 13 would be warped as shown by dotted line in FIG. 11. The distance from the surface of the developing electrode 10 and the magnet 13 would vary in the lengthwise direction of cylindrical shape of the developing electrode 10 and, as a result, the magnetic flux generated in the developing nip part would vary.

However, in the sixth embodiment, the protruded parts of the flange 23, which are integrally assembled with the developing electrode 10, ares pressed by pressing members 42, which allows the bending moment at the four points of contact between pressing members 42 and flange parts 23 to be cancelled. Furthermore, the protruded part of the flange 23 is inserted into the guide groove 62*a* of the electrode restricting member 62, so that the protruded part of the flange 23 and the side walls of the guide groove 62*a* can receive the external forces. Thus, the bending moment acting on the first center shaft 12 and the magnet 13 can be prevented, and warping may be prevented.

By the above-mentioned configuration, the distance between the surface of the developing electrode 10 and the magnet 13 can be maintained at a predetermined distance, and the magnetic field can stably be generated in the developing nip part at any time. As a result, a high quality picture image can be obtained.

SEVENTH EMBODIMENT

Figure 16:
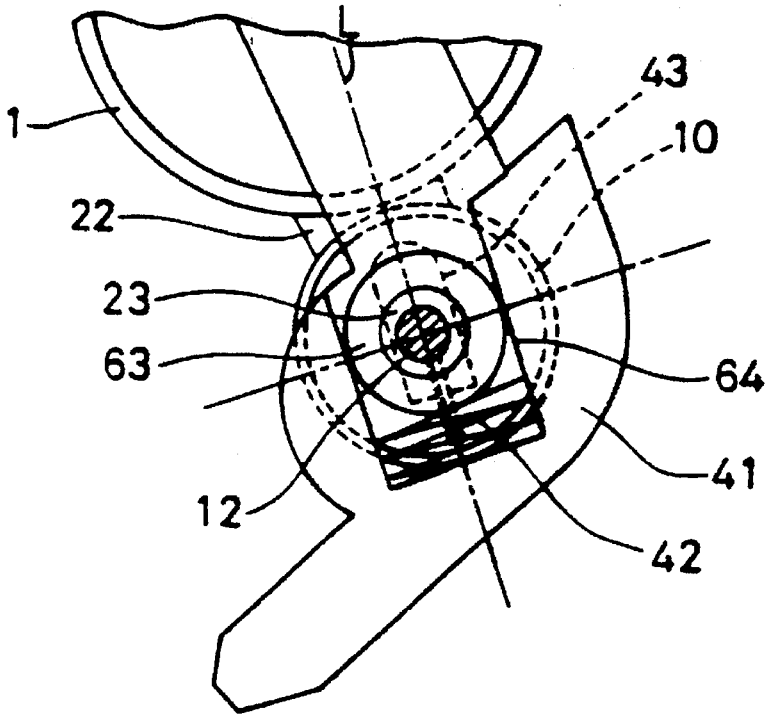
FIG. 16 is an enlarged side view showing a configuration of developing unit of an image forming apparatus of the seventh embodiment.
Figure 17:
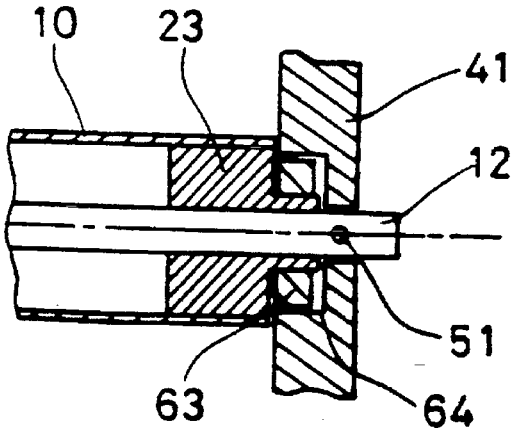
FIG. 17 is a sectional view of of developing electrode in a plane crossing the center axis of first center shaft and perpendicular to the axial standard line.

A seventh embodiment of an image forming apparatus of this invention is described referring to FIGS. 16 and 17. An enlarged side view showing a configuration of a developing unit of an image forming apparatus of the seventh embodiments shown in FIG. 16, and a sectional view of the developing electrode 10 in a plane crossing the center axis of first center shaft 12 and perpendicular to the axial standard line L is shown in FIG. 17. In the seventh embodiment, elements designated by the same numerals as those of the above-mentioned sixth embodiment are substantially the same. Thus, different points from the sixth embodiment are described.

As shown in FIGS. 16 and 17, a ring 63 is engaged with the protruded part of the flange 23. The developing electrode 10 and the flange 23 are rotatively pivoted by a bearing which is configured by an outer cylindrical face of the protruded part of the flange 23 and an inner cylindrical face of ring 63. A guide groove 64 having a width substantially the same as an outer diameter of the ring 63 is provided on the housing 41 of the developing unit. The ring 63 is engaged with the guide groove 64. The pressing member 42 is provided in the guide groove 64 for supplying a pressing force to ring 63. Pressing force of pressing member 42 acts on the developing electrode 10 via the ring 63 and the flange 23. Thus, the developing electrode 10 is pressed on the gap restricting member 22 and the gap restricting member 22 is also pressed on the photoconductor 1.

In the above-mentioned sixth embodiment, the pressing member 42 directly presses the protruded part of the flange 23 which is integrally assembled with the developing electrode 10. Namely, the pressing member 42, such as a coil spring, directly contacts the rotation shaft of a bearing of the developing electrode 10. If an end of the spring were caught between the flange 23 and the first center shaft 12 serving as the bearing, it would be impossible to supply a pressing force to the developing electrode 10 by the pressing member 42. As a result, the width of the developing gap between the photoconductor 1 and the developing electrode 10 would be expanded.

Furthermore, in the sixth embodiment, the rotating flange 23 directly slides on the side walls of the guide groove 43. If the friction force between the side walls of the guide groove 43 and the outer surface of the protruded part of the flange 23 were larger than the pressing force of pressing member 42, the protruded part of the flange 23 would roll on the inside walls of guide groove 43. As a result, the developing electrode 10 would move against photoconductor 1, and the width of the developing gap would be expanded. Furthermore, the position of magnet 13 would be displaced.

Furthermore, in the sixth embodiment, the guide groove 62*a* for guiding the movement of the flange 23 of developing electrode 10 is formed on the electrode restricting member 62 which is independent from the housing 41 the of developing unit. On the other hand, the guide groove 43 for guiding the movement of the first center shaft 12 is formed on the housing 41. If the positioning error between the positions of the guide grooves 43 and 62*a* were much larger, the setting angle of the first center shaft 12 and the magnet 13 would be changed when developing electrode was moved.

However, in the seventh embodiment configured above, the ring 63 is engaged with the protruded part of the flange 23, and the bearing of the developing electrode 10 is configured by the protruded part of the flange 23 and the ring 63. Furthermore, the ring 63 is guided by the guide groove 64, and the pressing member 42 is provided between the ring 63 and the guide groove 64. The pressing force of the pressing member 42 is supplied to the ring 63 which is not rotational. As a result, an end of the spring of the pressing member 42 will not be caught in the rotating bearing of the developing electrode 10. Furthermore, since the ring 63 is not rotational, the developing electrode 10 and the magnet 13, which are pivoted by the bearing configured by the protruded part of the flange 23 and the ring 63, may not be moved by the friction between the ring 63 and the side walls of the guide groove 64. Furthermore, since the guide grooves 43 and 64 are provided on the same housing 41, the guide grooves 43 and 64 can relatively be positioned accurately. Therefore, the magnetic field can be generated in the developing nip part more stably, and a high quality picture image can be obtained.

EIGHT EMBODIMENT

Figure 18:
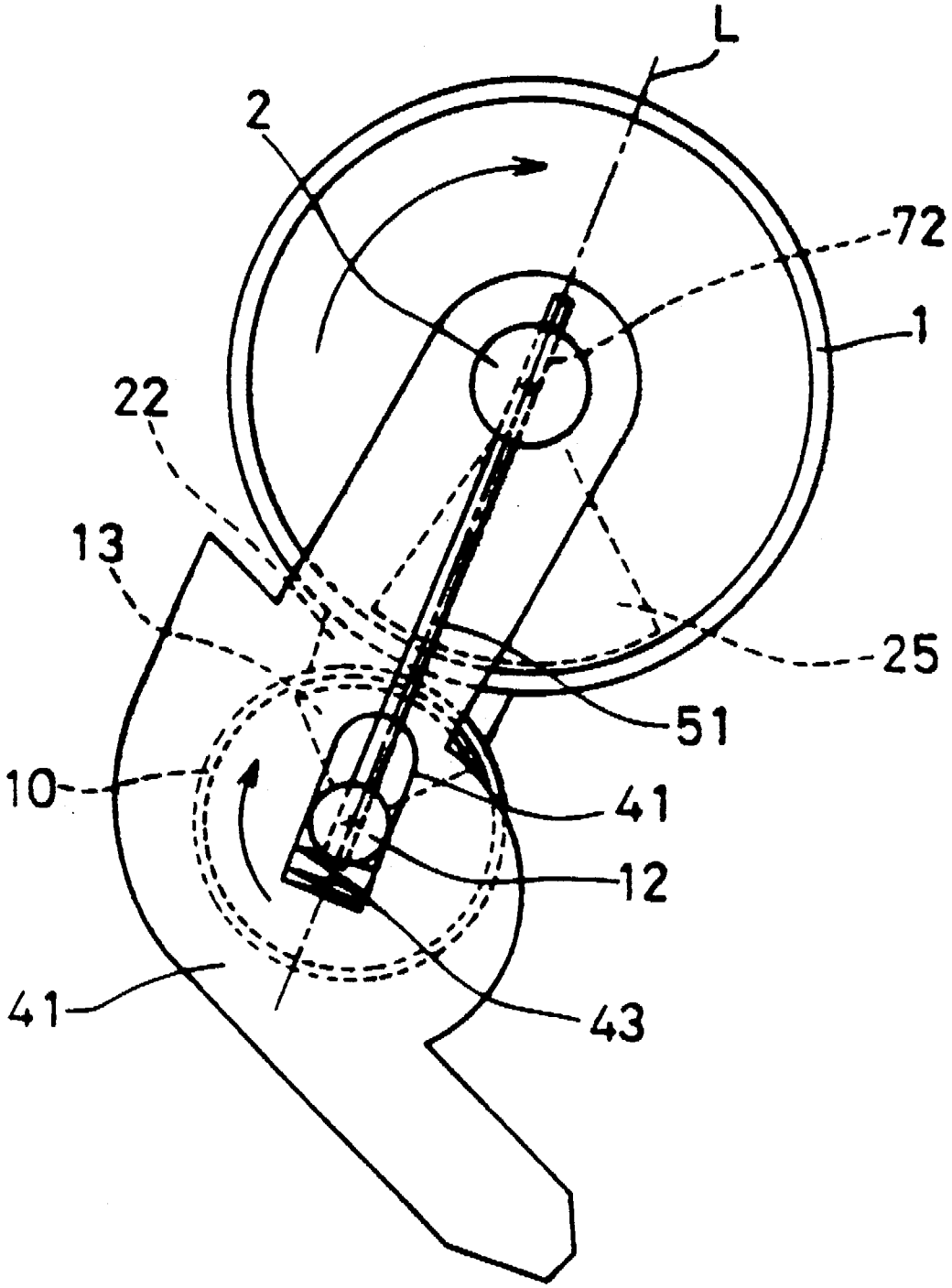
FIG. 18 is an enlarged side view showing a configuration of developing unit of an image forming apparatus of the eighth embodiment.
Figure 19:
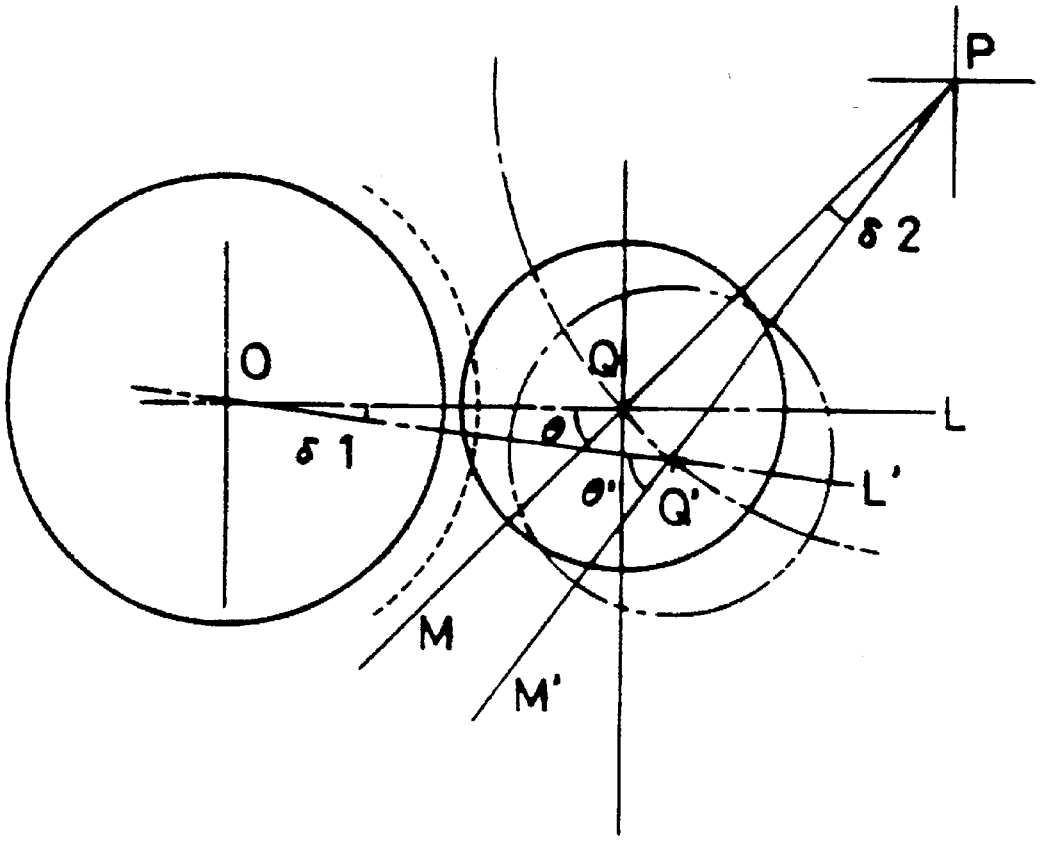
FIG. 19 (PRIOR ART)
FIG. 19 is a drawing schematically showing a condition that a setting angle of the magnet is changed by revolution of the developing electrode.

A eighth embodiment of an image forming apparatus of this invention is described referring to FIG. 18, which is an enlarged side view showing a configuration of a developing unit of an image forming apparatus of the eighth embodiment, in the eighth embodiment, elements designated by the same numerals as those of the above-mentioned fourth embodiment are substantially the same. Thus, different points from the fourth embodiment are described.

As shown in FIG. 18, a pin 51 which is fixed on and protruded from the first center shaft 12 is slidably inserted into a rotation restricting hole 72 of the first center shaft 12. By such a configuration, the setting angles of the magnets 13 and 25 are set by the same pin 51. As a result, the magnetic field can be generated in the developing nip part more stably.

In the above-mentioned first to eighth embodiments, the shapes of the photoconductor 1 and the developing electrode 10 are described as cylindrical. However, the shapes of these parts are not restricted by the above-mentioned embodiments, and the present invention can be applied even when the photoconductor and the developing electrode are belt shape which are made of elastic materials.

Furthermore, in the above-mentioned embodiments, the second center shaft 2 is coaxially disposed on the rotation axis of the photoconductor 1. However, the configuration of photoconductor 1 is not restricted to the above-mentioned configuration. If the rotation axis of photoconductor 1 can be defined by a configuration such that the photoconductor 1 is directly pivoted by the flange 24 and the magnetic field can be generated on the surface of the photoconductor 1 in the same manner, the position of the magnet can be restricted even when the magnet 25 is in the inside of the photoconductor.

Furthermore, if a magnet is coaxially fixed on the photoconductor or developing electrode and the developing gap is restricted by pressing the developing electrode on the photoconductor via the gap restricting member, the developing method is not restricted by that used in the above-mentioned embodiments.

What is claimed is:

1. An image forming apparatus comprising:

an image holder which is rotatable around a rotation axis thereof and capable of holding a pattern of electric charge corresponding to a picture image on a surface thereof;

a magnetic developer;

a developing electrode which faces said surface of said image holder with a predetermined gap, is rotatable around a rotation axis thereof, and reciprocally movable in a predetermined direction;

pressing means for supplying a pressing force to said developing electrode in said predetermined direction;

gap restricting means provided between said image holder and said developing electrode for restricting a distance between surfaces of said image holder and said developing electrode in said gap to a predetermined value;

first magnetic field generating means which is coaxially provided on said rotation axis of said developing electrode and is not rotatable about said rotation axis of said developing electrode;

electric field generating means for generating an electric field in a developing nip part of said image holder and said developing electrode; and a housing which supports each of the respective rotation axis of said image holder and said developing electrode;

wherein a first center shaft is coaxially disposed on said rotation axis of said developing electrode, at least one end of said first center shaft is engaged with a first center shaft guide groove, said first magnetic generating means is fixed on said first center shaft, and rotation of said first center shaft is restricted by a first rotation restricting means.

2. The image forming apparatus according to claim 1, further comprising:

developer accumulating means facing an outer surface of said image holder and temporarily accumulating said developer;

a second center shaft coaxially disposed on a rotation axis of said image holder;

second magnetic field generating means integrally fixed on said second center shaft and generating a magnetic field on a surface of said image holder.

3. The image forming apparatus according to claim 2, wherein a second rotation restricting means is comprised of a second rotation restricting part having a substantially D-shaped cross-section in a plane perpendicular to said rotation axis of said image holder and formed on at least one end of said second center shaft, and a second center shaft guide hole having substantially the same shape as that of said second rotation restricting part with which said second rotation restricting part is engaged.

4. The image forming apparatus according to claim 2, wherein a second rotation restricting means is comprised of a second pin which is protruded from a cylindrical face of said second center shaft, and a second rotation restricting groove with which said second pin is engaged.

5. The image forming apparatus according to claim 4, wherein said first center shaft guide groove and said second center shaft guide hole are provided on the same housing.

6. The image forming apparatus according to claim 1, wherein said pressing means is a coil spring disposed in said first center shaft guide groove for applying a pressing force to said first center shaft.

7. The image forming apparatus according to claim 1, wherein said first rotation restricting means is comprised of a first rotation restricting part formed on at least one end of said first center shaft, and of at least one side wall of said first center shaft guide groove.

8. The image forming apparatus according to claim 7, wherein said first rotation restricting part has a substantially D-shaped cross-section in a plane perpendicular to said rotation axis of said developing electrode, and a flat face of said D-shaped cross-section of said first rotation restricting part contacts said side wall of said first center shaft guide groove.

9. The image forming apparatus according to claim 8, wherein said first center guide groove has a pair of side walls parallel to the direction of said reciprocal movement of said developing electrode, and a width between said side walls is substantially the same as a height from said flat face to a top of a cylindrical face of said D-shaped cross-section of said first rotation restricting part.

10. The image forming apparatus according to claim 1, wherein said first rotation restricting means is comprised of a first pin which is protruded from a cylindrical face of said first center shaft, and a first rotation restricting groove with which said first pin is engaged.

11. The image forming apparatus according to claim 1, wherein reciprocal movement of said developing electrode is guided by developing electrode guide means which is independently provided from said first center shaft guide groove.

12. The image forming apparatus according to claim 11, wherein said developing electrode guide means is comprised of a protrusion formed on a flange of said developing electrode and a developing electrode guide groove.

13. The image forming apparatus according to claim 12, wherein a ring is engaged with said protrusion, and said ring slides on side walls of said developing electrode guide groove.

14. The image forming apparatus according to claim 13, wherein said pressing means is a coil spring disposed in said developing electrode guide groove for applying a pressing force to said ring.

15. The image forming apparatus according to claim 12, wherein said pressing means is a coil spring disposed in said developing electrode guide groove for applying a pressing force to said protrusion of said flange.

16. The image forming apparatus according to any one of claims 1 or 2, wherein direction of a reciprocal movement of said developing electrode crosses an axial standard line linking said rotation axes of said image holder and said developing electrode.

17. The image forming apparatus according to any one of claims 1 or 2 to 5, wherein direction of reciprocal movement of said developing electrode is parallel to an axial standard line linking said rotation axes of said image holder and said developing electrode.

18. An image forming apparatus comprising:

an image holder which is rotatable around a rotation axis thereof and capable of holding a pattern of electric charge corresponding to a picture image on a surface thereof;

developer accumulating means facing an outer surface of said image holder;

a magnetic developer which is supplied from said developer accumulating means to said outer surface of said image holder;

a developing electrode which faces said surface of said image holder with a predetermined gap, is rotatable around a rotation axis thereof in the opposite direction to the rotation direction of said image holder, and reciprocally movable in a predetermined direction;

a first center shaft which is coaxially disposed on said rotation axis of said developing electrode, at least one end of said first center shaft being engaged with a first center shaft guide groove;

first rotation restricting means for restricting rotation of said first center shaft;

pressing means for supplying a pressing force to said developing electrode in said predetermined direction;

gap restricting means provided between said image holder and said developing electrode for restricting a distance between surfaces of said image holder and said developing electrode in said gap to a predetermined value;

first magnetic field generating means which is coaxially fixed on said first center shaft and is not rotatable about said rotation axis of said developing electrode;

electric field generating means for generating an electric field in a developing nip part of said image holder and said developing electrode;

a housing in which said image holder and said developing electrode are disposed;

a second center shaft coaxially disposed on a rotation axis of said image holder;

second magnetic field generating means integrally fixed on said second center shaft and generating a magnetic field on a surface of said image holder; and second rotation restricting means for restricting rotation of said second center shaft.

19. The image forming apparatus according to claim 18, wherein said pressing means is a coil spring disposed in said first center shaft guide groove for applying a pressing force to said first center shaft.

20. The image forming apparatus according to claim 18, wherein said first rotation restricting means is comprised of a first rotation restricting part formed on at least one end of said first center shaft, and of at least one side wall of said first center shaft guide groove.

21. The image forming apparatus according to claim 20, wherein said first rotation restricting part has a substantially D-shaped cross-section in a plane perpendicular to said rotation axis of said developing electrode, and a flat face of said D-shaped cross-section of said first rotation restricting part contacts said side wall of said first center shaft guide groove.

22. The image forming apparatus according to claim 21, wherein said first center guide groove has a pair of side walls parallel to the direction of said reciprocal movement of said developing electrode, and a width between said side walls is substantially the same as a height from said flat face to a top of a cylindrical face of said D-shaped cross-section of said first rotation restricting part.

23. The image forming apparatus according to claim 18, wherein said first rotation restricting means is comprised of a first pin which is protruded from a cylindrical face of said first center shaft, and a first rotation restricting groove with which said first pin is engaged.

24. The image forming apparatus according to claim 18, wherein reciprocal movement of said developing electrode is guided by developing electrode guide means which is independently provided from said first center shaft guide groove.

25. The image forming apparatus according to claim 24, wherein said developing electrode guide means is comprised of a protrusion formed on a flange of said developing electrode and a developing electrode guide groove.

26. The image forming apparatus according to claim 25, wherein a ring is engaged with said protrusion, and said ring slides on side walls of said developing electrode guide groove.

27. The image forming apparatus according to claim 26, wherein said pressing means is a coil spring disposed in said developing electrode guide groove for applying a pressing force to said ring.

28. The image forming apparatus according to claim 25, wherein said pressing means is a coil spring disposed in said developing electrode guide groove for applying a pressing force to said protrusion of said flange.

29. The image forming apparatus according to claim 18, wherein said second rotation restricting means is comprised of a second rotation restricting part having a substantially D-shaped cross-section in a plane perpendicular to said rotation axis of said image holder and formed on at least one end of said second center shaft, and a second center shaft guide hole having substantially the same shape as that of said second rotation restricting part with which said second rotation restricting part is engaged.

30. The image forming apparatus according to claim 29, wherein said first center shaft guide groove and said second center shaft guide hole are provided on the same housing.

31. The image forming apparatus according to claim 18, wherein said second rotation restricting means is comprised of a second pin which is protruded from a cylindrical face of said second center shaft, and a second rotation restricting groove with which said second pin is engaged.

32. The image forming apparatus according to one selected among claims 18 to 30, wherein direction of a reciprocal movement of said developing electrode crosses an axial standard line linking said rotation axes of said image holder and said developing electrode.

33. The image forming apparatus according to claim 32, further comprising:

transfer means for transferring a developed image from the surface of said image holder to a surface of a paper sheet; and cleaning means disposed for contacting the surface of said image holder and removing said developer remaining on the surface of said image holder.

34. The image forming apparatus according to one selected among claims 18 to 30, wherein direction of reciprocal movement of said developing electrode is parallel to an axial standard line linking said rotation axes of said image holder and said developing electrode.

35. The image forming apparatus according to claim 34, further comprising:

transfer means for transferring a developed image from the surface of said image holder to a surface of a paper sheet; and cleaning means disposed for contacting the surface of said image holder at a point on the extension of a line linking said rotation axes of said image holder and said developing electrode and removing said developer remaining on the surface of said image holder.

* * * * *